United States Patent [19]

Scherrer

[11] 4,408,433

[45] Oct. 11, 1983

[54] SECTION CONSTITUTING AN OUTER LONGITUDINAL ELEMENT OR MOULDING OF A FALSE CEILING OR A FALSE WALL

[76] Inventor: Fernand Scherrer, 2, rue Georges Bizet, 68170 Rixheim, France

[21] Appl. No.: 231,101

[22] Filed: Feb. 3, 1981

[30] Foreign Application Priority Data

Feb. 5, 1980 [FR] France ..... 80 02438

[51] Int. Cl.[3] ..... E04B 1/00

[52] U.S. Cl. ..... 52/738; 52/222; 52/302

[58] Field of Search ..... 52/222, 484, 474, 273, 52/486, 302, 303, 738; 160/395; 98/40 R, 40 C, 40 D

[56] References Cited

U.S. PATENT DOCUMENTS

| | | | |
|---|---|---|---|
| 3,101,661 | 8/1963 | Bibb | 98/40 D |
| 3,205,628 | 9/1965 | Frisk | 52/222 |
| 3,719,013 | 3/1973 | Blick | 52/222 |
| 4,083,157 | 4/1978 | Anthonioz | 52/222 |

*Primary Examiner*—John E. Murtagh
*Assistant Examiner*—Kathryn Ford
*Attorney, Agent, or Firm*—McAulay, Fields, Fisher, Goldstein & Nissen

[57] ABSTRACT

A section constituting an outer longitudinal element or moulding of a false ceiling or false wall, is constituted substantially by an angle of which the vertical flange is applied against a wall and the horizontal flange presents a shoulder extending towards the vertical flange to ensure fastening of a hook-shaped edging fast with a sheet of plastics material or cloth maintained stretched by the section.

The horizontal shoulder defines, with the horizontal flange, a groove whose cross section is in the form of a U open towards the vertical flange. A cant provided in the angle constituting the section joins the horizontal flange inside the U-groove so as to define, between this cant and the shoulder, a narrow passage of width slightly larger than the thickness of the part of the edging which is engaged in the U-groove.

8 Claims, 2 Drawing Figures

SECTION CONSTITUTING AN OUTER LONGITUDINAL ELEMENT OR MOULDING OF A FALSE CEILING OR A FALSE WALL

BACKGROUND OF THE INVENTION

The present invention relates to a section constituting an outer longitudinal element or moulding of a false ceiling or a false wall.

False ceilings are already known which comprise, on the one hand, a horizontal frame fixed to the top of the walls of a room, this frame being formed by an outer longitudinal element itself constituted by sections joined end to end and, on the other hand, a sheet of plastics material or cloth maintained stretched inside the frame due to the engagement therein of an edge fixed to the sheet. The cross section of this edge forms a hook which grips on a shoulder of the section constituting the longitudinal element, this shoulder extending in direction opposite that in which pulling is effected.

SUMMARY OF THE INVENTION

The present invention relates to improvements to the section constituting the above-mentioned outer longitudinal element with a view to improving the anchoring of the stretched sheet or cloth on the section, the rigidity of the latter and the ventilation.

To this end, the outer longitudinal element or moulding of a false ceiling or false wall, constituted substantially by a frame vertical flange is applied against a wall and whose horizontal flange presents a shoulder extending towards the vertical flange to ensure fastening of a hook-shaped edge fast with a sheet of plastics material or cloth maintained stretched by the section, is characterised in that the horizontal shoulder defines, with the horizontal flange, a groove whose cross-section is in the form of a U open towards the vertical flange and that a cant provided in the angle constituting the section joins the horizontal flange inside the U-groove so as to define between this cant and the shoulder, a narrow passage having a width slightly larger than the thickness of the part of the edge which is engaged in the U-shaped groove.

According to a further feature of the invention, the cant defines the upper surface of a prismatic tube having a cross section in the form of a right-angled triangle.

According to another feature of the invention, the vertical flange is provided with at least two horizontal, longitudinal ribs, projecting outwardly, by which it abuts on the wall, and elongated openings are made in the part of the vertical flange located just above the cant, below the lower outer rib.

The frame according to the invention offers the advantage that it ensures a perfect hold of the edge of the sheet of plastics material or cloth, once this edge is hooked on the shoulder and engaged in the U-groove. In fact, the part of the edge which is engaged in the U-groove cannot be deformed as it is maintained in position by the cant leading in the groove. Furthermore, the frame has increased rigidity due to the tubular structure formed in the horizontal flange. Finally, the holes made in the vertical flange enable the pressures to be balanced, ensuring communication between the inside of a room and the volume located above the sheet constituting the false ceiling.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
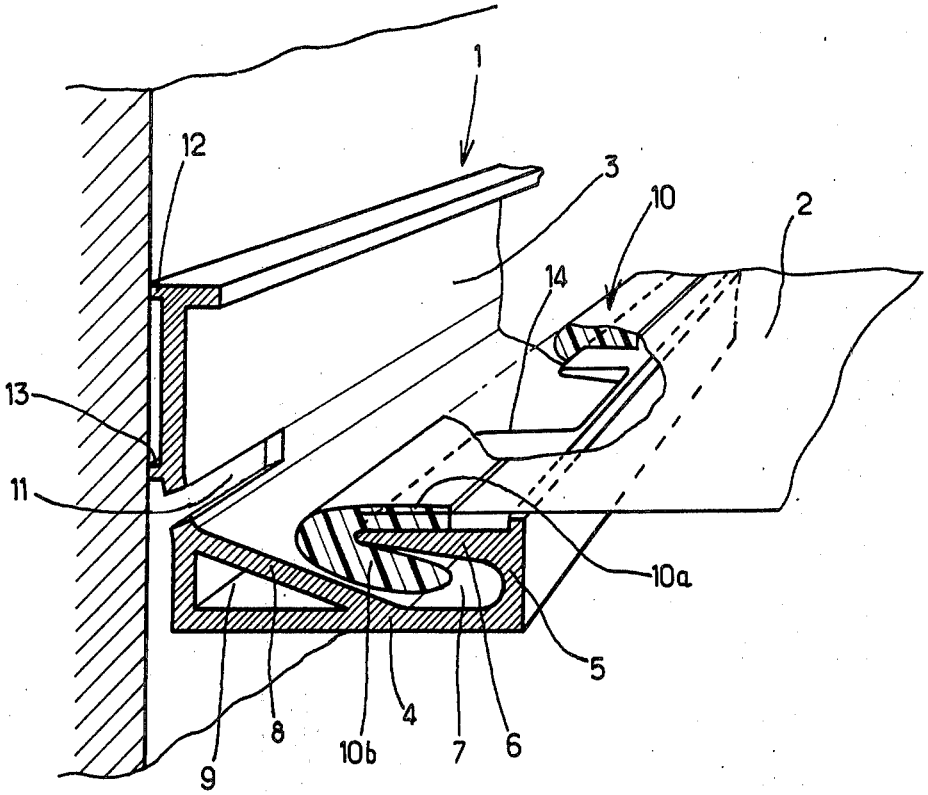
FIG. 1 is a partial view in perspective of a frame constituting an outer longitudinal element or moulding of a false ceiling.
Figure 2:
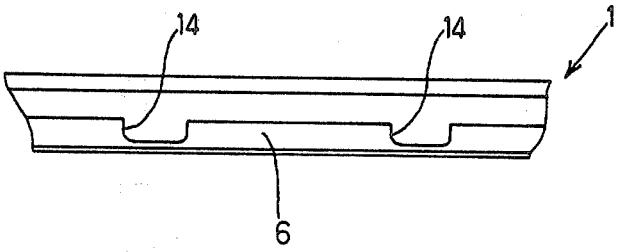
FIG. 2 is a plan view of frame.

Referring now to the drawings, the section 1 according to the invention, which is shown in FIG. 1, constitutes an outer longitudinal element or moulding of a false ceiling comprising a sheet 2 of polyvinyl chloride or like material, which is maintained stretched horizontally inside frame 1.

Frame 1 is generally in the form of an angle and it comprises a vertical flange 3 by which it is fixed to a wall, and a lower horizontal flange 4 extending into the room and terminated by an upwardly turned vertical edge 5. This edge 5 extends into a shoulder 6 which is constituted by a horizontal rib extending towards the vertical flange 3. The thickness of this rib preferably decreases in the direction of the vertical flange 3. The horizontal shoulder 6, the vertical edge 5 and the horizontal flange 4 thus define a groove 7 of U-section open towards the vertical flange 3.

The lower part of frame 1 has a cant 8 connecting the horizontal and vertical flanges 4 and 3 respectively, thus defining a prismatic tube 9 having a cross section in the form of a right-angled triangle. This tubular structure increases the rigidity of frame 1.

The sheet 2 is provided along its end with an edge 10 made of plastics material and which forms a hook opening towards the inside of the sheet. This edge 10 comprises a thin part **10*a* by which it is fixed to the sheet 2, for example by high-frequency welding, this thin part extending outwardly and beneath the sheet 2 by a thicker part 10*b*** constituting a bead of rounded or angular form.

When the sheet 2 is hooked to the section 1 and maintained stretched, the edge 10 is hooked on the shoulder 6, its thick part **10*b* being engaged in the U-sectioned groove 7. As may be seen from the drawing, the cant 8 joins the horizontal flange 4 in a zone located inside the groove 7 and it defines with the horizontal shoulder 6 a passage whose width is slightly larger than the thickness of the part 10*b* of the edging 10. In this way, the cant 8 prevents any deformation of the hook-shaped edge 10 which might result from a considerable pull exerted on the sheet 2. Frame 1 thus enables the sheet 2** to be firmly engaged and maintained stretched.

In the vertical flange 3 of frame 1 are made openings 11 which extend horizontally just above the zone where the cant 8 joins the vertical flange 3. These openings 11 establish a communication between the interior of the room and the volume located above the sheet 2, to balance the pressures. To promote the passage of air through the openings 11, the vertical flange 3 of the section 1 is preferably maintained slightly away from the wall, due to the provision, on the outer face of this vertical flange 3, of two longitudinal, horizontal ribs, namely an upper rib 12 and a lower rib 13.

Furthermore, in order to increase further the distance between the openings 11 and the wall to which the section 1 is fixed, the flange 3 of this section may include, just above the cant 8, a part which is slightly inclined inwardly and downwardly, which results in the lower end part of the vertical flange 3 which forms part of the prismatic tube 9 being further away from the wall than the upper part of said flange 3.

According to a further feature of the invention, frame 1 presents in the rib constituting the shoulder 6, a succession of notches 14 opening in the edge of the shoulder, these notches being located at a short distance from one another (distance between the notches: from about 10 to 12 cm). These notches enable the hook-shaped edge 10 to be held on the shoulder 6 whilst the sheet 2 is being engaged. The edge 10 is in fact retained in the successive notches 14 as each portion of the edge is engaged on the corresponding portion of shoulder 6 included between two successive notches 14.

What is claimed is:

1. A frame for a false ceiling or false wall, comprising a first flange adapted to be attached to the edges of a wall;

a second flange angularly related to said first flange;

said second flange terminating in a shoulder extending towards said first flange;

said shoulder defining with said second flange a generally U-shaped groove open towards said first flange and adapted to receive therein a hook-shaped portion of the rigid edge of a sheet;

said second flange including a prismatic tubular part having a triangular cross-section;

said part having a sloping surface leading from said first flange to said groove and defining with said shoulder a passage having a width slightly greater than the thickness of said hook-shaped portion of said edge to hold said portion and prevent deformation thereof;

said first flange having openings above said sloping surface; and spaced longitudinal ribs outwardly extending from said first flange, one of said ribs forming the end of said first flange and having an inwardly extending portion parallel to said second flange.

2. The frame of claim 1, wherein said shoulder has a purality of spaced notches in the edge thereof to hold the hook-shaped portion of said edge of said sheet.

3. The frame of claim 1 wherein the cross-section of said prismatic tubular part is a right-angled triangle.

4. The frame of claim 2 wherein the cross-section of said prismatic tubular part is a right-angled triangle.

5. The frame of claim 1 wherein said openings in said first flange are above said prismatic tubular part and below said ribs.

6. The frame of claim 4 wherein said openings in said first flange are above said right-angled triangle and below said ribs.

7. The frame of claim 1 wherein said shoulder is constituted by a horizontal rib, the thickness of said rib decreasing in the direction extending towards said first flange.

8. The frame of claim 6 wherein said shoulder is constituted by a horizontal rib, the thickness of which decreases in the direction of said first flange.

* * * * *